United States Patent [19]

Yoshida et al.

[11] Patent Number: 4,557,816

[45] Date of Patent: Dec. 10, 1985

[54] ELECTROLYTIC CELL WITH ION EXCHANGE MEMBRANE

[75] Inventors: Muneo Yoshida; Yoshitomo Tamura, both of Nobeoka, Japan

[73] Assignee: Asahi Kasei Kogyo Kabushiki Kaisha, Osaka, Japan

[21] Appl. No.: 507,558

[22] Filed: Jun. 24, 1983

[30] Foreign Application Priority Data

Jul. 6, 1982 [JP] Japan ..... 57-116236

[51] Int. Cl.[4] ..... C25B 9/00; C25B 11/03; C25B 13/08

[52] U.S. Cl. ..... 204/255; 204/263; 204/283; 204/296

[58] Field of Search ..... 204/255–258, 204/263–266, 283, 284, 286, 288, 289, 296

[56] References Cited

U.S. PATENT DOCUMENTS

| | | | |
|---|---|---|---|
| 3,836,448 | 9/1974 | Bouy et al. | 204/258 X |
| 4,069,129 | 1/1978 | Sato et al. | 204/258 |
| 4,138,295 | 2/1979 | DeNora et al. | 204/258 X |
| 4,149,952 | 4/1979 | Sato et al. | 204/258 |
| 4,322,281 | 3/1982 | Wright et al. | 204/237 |
| 4,378,286 | 3/1983 | Eng et al. | 204/257 |

FOREIGN PATENT DOCUMENTS

| | | | |
|---|---|---|---|
| 341545 | 2/1977 | Austria . | |
| 52880 | 6/1982 | European Pat. Off. . | |
| 2023181 | 12/1979 | United Kingdom | 204/252 |

*Primary Examiner*—Donald R. Valentine

*Attorney, Agent, or Firm*—Birch, Stewart, Kolasch & Birch

[57] ABSTRACT

A chlor-alkali electrolytic cell with a cation exchange membrane is improved, with respect to eliminating local differences of electrolyte, by providing a duct to facilitate downward flow of electrolyte. The duct of this invention serves, without increase of current leakage, with results comparable to conventional forced circulation.

29 Claims, 6 Drawing Figures

507558
FIG. 1-A
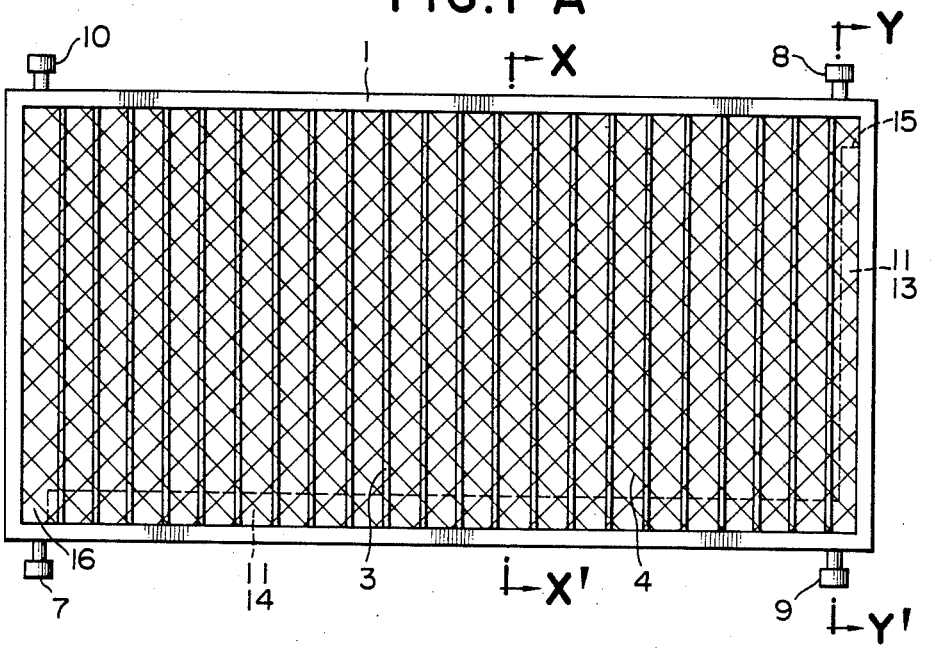
FIG. 1-B
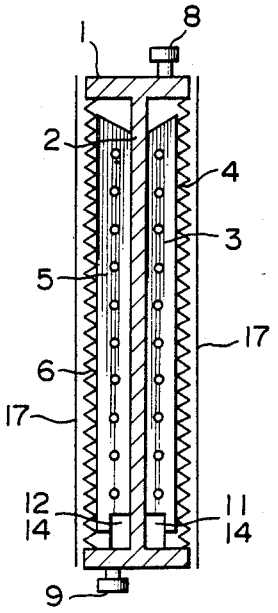
FIG. 1-C
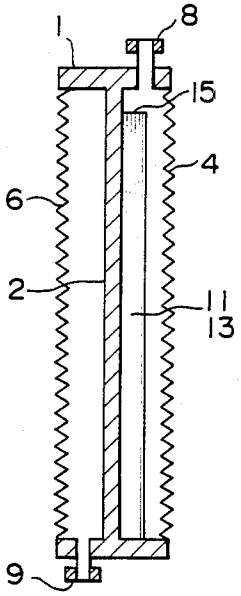

ELECTROLYTIC CELL WITH ION EXCHANGE MEMBRANE

FIELD OF THE INVENTION

This invention relates to an electrolytic cell with a cation exchange membrane for electrolysis of a chlor-alkali aqueous solution. In particular, this invention relates to an electrolytic cell comprising a duct in an electrolytic compartment to effect liquid circulation therein.

BACKGROUND OF THE INVENTION

Recently, the ion-exchange membrane process is experiencing, for its merit of energy saving, quality product and non-pollution, a reputation that this process is superior to conventional amalgam or diaphragm processes. It is also known that a key factor for successful operation thereof depends on full utilization of the capability the cation exchange membrane, such as accomplishment of the stable electrolysis for a long period under high-current density. Moreover, it has been shown that performance of a cation exchange membrane and allowable current density are largely influenced by, for example, concentrations of catholyte and of anolyte, and pH of anolyte. Accordingly, a necessary requirement resides in the prevention of undesirable effects caused by evolving gas and of local differences in current as well as temperature distributions in the compartments.

Conventionally, countermeasures for equalizing locality in concentration of electrolyte and for preventing adverse effects by gas have been directed to the provision of a circulation system including a pump and a tank to conduct forced circulation between electrolytic cells and the tank. But the conventional measures above are not free from defects of increase in utility cost, equipment costs in tanks, pumps or pipings for circulation. Also, current leakage through the circulation system adversely reduces current efficiency.

Some attempts have been made to overcome the above defects, as shown in the following publications, by producing natural circulation of electrolyte, utilizing gas-lift effect and local difference in gross density of the electrolyte.

(a) Japanese examined patent publication No. 737/65

This publication sets up two separate electrolyte routes, gas-contained and gas-free, by combining gas-evolving compartments and gas-free ones, respectively, so as to line up a converged loop. But this attempt requires complex modifications to an electrolytic assembly.

(b) Japanese examined patent publication No. 26194/80

This publication discloses an exterior circulation system comprising upper flowout and lower flowin piping and connection therewith. But this sort of exterior system increases unfavorable current leakage.

(c) Japanese unexamined utility model publication No. 3958/78

This publication attempts to set a guide plate in the electrolyte mass so that upward flow, aroused by gas bubbles, may be separated from downward flow. But this idea requires voluminous compartment space, therefore apparatus efficiency is lowered.

Besides, Japanese unexamined utility model publication Nos. 42027/80 and 42054/80 disclose provision of dispersion nozzles beside a feeding hole for fresh electrolyte, with an idea of equalizing concentration across a compartment. But the dispersion nozzle incurs blocking problems during operation.

SUMMARY OF INVENTION

An object of this invention is to provide an electrolytic cell with a cation exchange membrane capable of electrolysis up to high current density with uniform concentration distribution of electrolyte in compartments without forced circulation, even if a feeding amount of electrolyte is made as small as possible.

The object is accomplished in this invention by providing an open-ended duct in a rear space of an electrode, either or both the anode and cathode, and by setting an upper opening thereof at an upper part of its compartment and a lower opening thereof at a lower part thereof.

DETAILED DESCRIPTION OF THE INVENTION

In the following description of the invention, a rear space refers to a space adjacent to the side of a planar electrode which faces a cation exchange membrane at one side thereof and, accordingly, this space is where no current is applied. A duct in this invention refers to a square or circular hollow tube, consisting of one or a few parts, disposed in a rear space of a compartment, either vertically or vertically and horizontally. The horizontal disposition above means a part of a duct which connects with the bottom end of vertical part thereof. In other words, a duct in this invention may take a shape like the letter I or L. The duct in this invention is required to have only upper (top) and lower (bottom) openings. Accordingly, gas bubbles evolving at an electrode, which tend to flow upward, are scarcely allowed to enter into the duct so that a difference in gross density of electrolyte takes place readily between the exterior and interior of the duct. Down flow occurs in the duct while upward flow occur outside of the duct to produce natural circulation of electrolyte in the compartment. Thus, the natural circulation in an electrolytic cell of the invention serves to equalize distribution of concentration therein and to rapidly remove evolved gas. Generally, the larger current density brings the wider range of distribution of concentration in a compartment, and, also, the larger current density increases the gas evolution, which leads the greater difference in gross density between the exterior and interior of a duct to cause greater circulation. Consequently, the cells of the invention can effectively maintain uniform or equal distribution of concentration even under high current density.

Generally, deviation of concentration distributes not only in a vertical direction, but also in a horizontal or transverse direction. Elimination thereof in the horizontal direction necessarily requires circulation in the same direction. Therefore, a duct having a horizontal part as well as vertical part is suited to the above, for the merit of also producing a transverse transfer. In the case of an electrolytic compartment having a size of not less than 1 meter in transverse or frame beam direction, a duct having a horizontal part or L letter shape is suitable.

It is true that electrolyte circulation is most favored if it occurs between a spot with the lowest concentration and a spot with the highest. Therefore, an upper opening of a duct should be adjusted close to an outlet hole for spent electrolyte and electrolytic product. Likewise, a lower opening of a duct should be adjusted close to an inlet hole for fresh electrolyte. More specifically, the horizontal distance between the upper opening of a duct and the outlet of electrolyte or between the lower opening of a duct and the inlet of electrolyte should preferably be within ⅓ of transverse length of the current applied area. Furthermore, saturated brine with high acid concentration may reside in the neighborhood of the anolyte inlet and some water may reside in the neighborhood of the catholyte inlet. Therefore, a lower opening of a duct is preferably adjusted close to dispose within 10 cm off an electrolyte inlet.

The driving force of natural circulation is defined by the product of gross density difference of electrolyte and vertical length of duct, which leads the longer vertical duct to be the more favorable. A length of more than 50 cm is favorable to various operating conditions. However, disposition of the upper opening of the duct too close to the upper wall of a cell may invite a decrease of circulation volume and consequently less equalization of deviated concentration. In view of above, the upper opening of the duct should be adjusted at a distance of more than 5 cm down the upper wall, preferably more than 10 cm. In particular, the upper opening of the duct in the anode compartment should be most preferably adjusted 10–15 cm down the upper wall, because the upper part of the anode compartment normally is of gas-liquid mixture with a majority of gas and frequent occurrence of gas entrainment into a duct causes the gross density difference to be less between the inside and outside of the duct.

With respect to the duct, the sectional shape is not restrictive, but a rectangular cross-sectional shape is preferable in order to utilize a rear space of an electrode. The dimension of the duct may be chiefly determined according to that required for circulation, which depends upon current efficiency of the membrane employed, utilization degree of brine, individual construction of an electrolytic cell and size of the current-applied area. However, to equalize deviated concentration in a compartment, circulation of more than 20 lit/hr, preferably 30 lit/hr, more preferably 60 lit/hr is required for current 1 KA. And a gap, not less than 2–3 mm, preferably about 5 mm, should be maintained between an electrode and a duct body in order not to block flow of electrolyte.

As for the material for fabricating a duct, any sort is available as long as it is corrosion resistant under electrolysis conditions. Generally, there may be used fluorine-containing resin, polyvinyl chloride resin, polyolefin resin; iron, nickel, titanium and other corrosion resistant metal or alloy; fluorin-containing rubber, silicone rubber, EPDM and other rubber and derivatives thereof.

As for construction of the electrolytic cell or compartment, this invention is applicable to any sort so far as it provides a space behind an electrode and said space is enough to set a duct therein, and is also applicable to either monopolar or bipolar system. Specially, this invention is advantageously applied to a bipolar system electrolytic cell, because, by this invention, this type of cell can eliminate external circulation of electrolyte. In this manner, current leakage is minimized.

Provision of a duct according to this invention brings full effects when it is provided in both the anode and cathode compartments, and provision of a duct in either compartment, either the anode or cathode, is comparably useful. As between the two compartments, placement of the duct in the anode compartment will probably be more meritorious where some expensive material, like titanium, is employed.

EXPLANATION OF DRAWINGS

The FIG. 1-A is plan of a unit cell of this invention, and FIGS. 1-B and 1-C are views directed to the arrow lines X—X' and Y—Y', respectively.

In FIGS. 1-A, B, C, a frame (1) has a partition wall (2) and left and right flanges as seen in 1-B and 1-C, where from one side of the wall (2) extend several vertical ribs (3) which support an anode (4) shown as a vertical zigzag line. In contrast, from another side thereof extend several ribs (5) which support a cathode (6) shown as a vertical zigzag line. Thereby, an anode compartment (right) and a cathode compartment (left) are defined.

Figure 2:
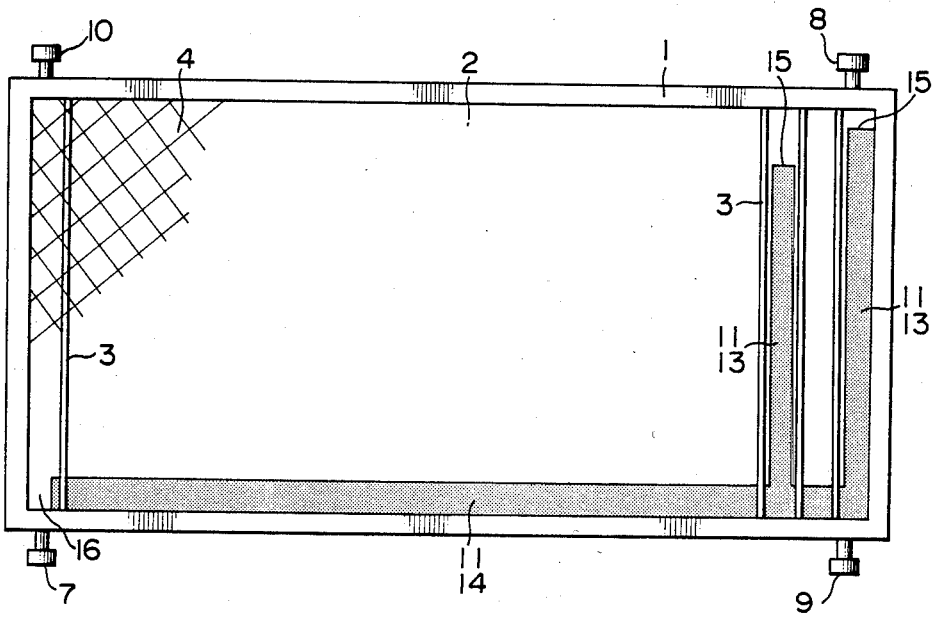
FIG. 2 and FIG. 3 show embodiments of this invention different from that of FIG. 1.

A series of cell units described above is assembled to line up while a cation exchange membrane (17) and two electrodes (4) and (6) at the both sides thereof are interposed between cell units, with termination of either an anode or a cathode compartment at the assembly end. (The termination is not shown in Figures.)

All of them above are often compressed in a stack assembly like fastening a filter press. Thus a bipolar system electrolytic cell is produced. Also, in these figures, (7) is an inlet for fresh anolyte, (8) is an outlet for spent anolyte and evolved chlorine gas. (9) is an inlet for fresh catholyte and (10) is an outlet for spent catholyte and evolved hydrogen gas. Ribs (3) and (5) form recessed spaces behind the anodes and cathodes, where ducts (11) and (12), respectively, having a vertical part (13) and a horizontal part (14) are set in parallel with planar electrodes (4) and (6). The duct has an upper opening (15) at the upper edge and a lower opening (16) at the lower edge.

In operation, to take an anode compartment for instance, chlorine gas evolving at an anode (4) does not come into a duct (11), because the duct has no openings other than (15) and (16), and all that enters into the duct is spent anolyte containing scarce amounts gas, heavier than gas-containing liquid. In this manner, duct interior obtains a larger density than the duct exterior such that the duct establishes a certain downward flow.

More specifically, spent anolyte having low brine concentration and acidity flows into the upper opening (15) which is adjusted close to the outlet (8), and the spent anolyte flows out at the lower opening (16) which is adjusted close to the inlet (7). Thus, fresh anolyte having high brine concentration and acidity is mixed with spent anolyte having low concentration and acidity so that, regularly, equalization of concentration and acidity of the anolyte is realized. The same is true with a cathode compartment where a duct (12) is set.

FIG. 2 shows a different embodiment of a duct. (Reference numbers are the same as those in FIG. 1). In this embodiment, a plurality of vertical parts (13) is provided with one duct (11). This is effective for cases where gas separation occurs poorly or for cases where a flow dead zone occurs in the electrolyte. However, it should be noted that excessive vertical parts (13) may cause a rear space to be less available for flow of electrolyte, thereby causing, poor gas-separation and voltage increase. In conclusion, the ratio of the projected area of a duct to the current-applied area should be less than $\frac{1}{3}$.

Figure 3:
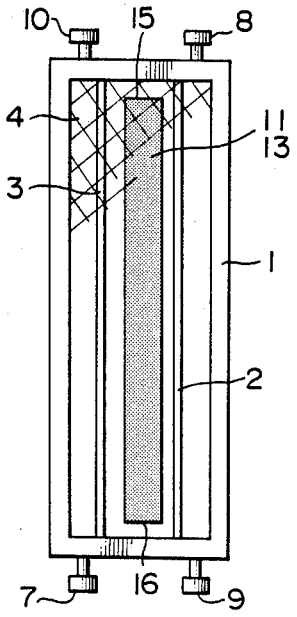

FIG. 3 shows an embodiment of a duct suitable for a cell with short transverse length. Where a transverse length is no more than 50 cm, a duct consisting of vertical part (11), with no horizontal part, is preferably positioned to stand on about the center of a cell.

Referring to a cation exchange membrane to be used in this invention, any sort may be used so far as applicable to chlor-alkali electrolysis. Recently, a membrane consisting of perfluorocarbon containing carboxylic acid groups is recognized to be adequate for chlor-alkali electrolysis in terms of current efficiency. This sort of membrane is particularly suitable for this invention.

In operation of chlor-alkali electrolysis, generally, back migration of hydroxyl ion, from a cathode compartment to an anode compartment through the membrane, should be neutralized by addition of acid to the anode compartment. Otherwise, the back migration causes accumulation of chlorate in the anode compartment, increase of oxygen gas in chlorine gas, rapid exhaust of a coating material on the anodes and other troubles.

On the other hand, carboxylic acid groups in a membrane become undissociated when it encounters high acid concentration whereby an increase in electrolysis voltage is aroused. If the same operation should be continued forcibly, it might cause blistering and eventually a break in the membrane. However, in operation of a cell of this invention, it is allowed to feed brine with high acidity for neutralization of back-migrating hydroxyl ions, because the cell of this invention is capable of successfully equalizing acid distribution in the anode compartment, thereby preventing damage of the membrane and electrolysis voltage increase.

Referring to an electrode in this invention, porous planar electrode, e.g. expanded metal, lattice or net-like metal, and perforated metal sheet are available. Alternatively, lined metal rods may be used. For the anode material, any materials usually used for chlor-alkali electrolysis are acceptable. That is, titanium, zirconium, tantalum, niobium, and alloys of these metals may serve as the base, the surface of which is coated with an active material for an anode containing a platinum group metal oxide (e.g. ruthenium oxide) as a main component. The cathode material may be iron, nickel, and alloys thereof as such, or covered with an active material for a cathode, e.g. Raney nickel, Rhodan nickel, nickel oxide. As for the chlor-alkali aqueous solution in this invention, industrial importance resides in sodium chloride, potassium chloride, but there is no more substantial restriction.

As described above, the electrolytic cell of this invention is capable of equalizing deviations of concentration, pH and temperature distribution of electrolyte, whereby the following advantages are attained.

1. Operation under high current density, 30 A/dm$^2$ or higher.
2. Decreased voltage.
3. Longer life of cation exhange membrane and the same of anode.
4. Better product quality of chlorine gas and alkali metal hydroxide.

The electrolytic cell of this invention provides a duct in a compartment to accomplish natural circulation of electrolyte, whereby the following advantages are attained.

5. Lower plant construction cost and operating cost thereof.
6. Adequate circulation is invariably maintained even when, besides a duct of this invention, an orifice is set up at a fresh electrolyte inlet for equalizing feed rate to each cell or when a nozzle, disclosed in Japanese unexamined patent publication No. 5988/81, where external natural circulation is made with a head tank above a cell, is applied additionally.
7. Prevention of loss caused by leakage current.

EMBODIMENTS OF THE INVENTION

This invention will be illustrated by examples in the following, but these should not be construed to limit this invention.

EXAMPLE 1

Electrolysis of an NaCl aq. solution was carried out in a bipolar system electrolytic cell with such construction as shown in FIG. 1. Current-applied area was defined by 115 cm of height and 235 cm of transverse. A recess depth of a rear space adjacent to an electrode was 3 cm. An anode was made of a perforated titanium plate having 1 mm thick, coated with ruthenium oxide. A cathode was made of a perforated mild steel plate having 1 mm thick. In the rear space adjacent to the cathode, a duct made of a stainless steel plate with 1 mm thick and, in the rear space adjacent to the anode, a duct made of titanium plate with 1 mm thick, shaped commonly in rectangular section of 2.5 cm$\times$8 cm, were set, respectively, and an upper opening thereof was positioned just below the outlet for spent electrolyte and electrolytic product, specifically at the height of 105 cm. A lower opening thereof was positioned 2 cm off an inlet for fresh electrolyte.

The membrane polymer was prepared by copolymerization of tetrafluoroethylene and perfluoro-3,6-dioxy-4-methyl-7-octenesulfonyl fluoride. Two sorts of polymers, one having equivalent weight of 1350 (polymer 1) and another having 1100 (Polymer 2), were obtained therefrom. Then, these two polymers were subjected to heat fabrication, and thereby a two ply laminate was manufactured by combination of 35 microns of polymer 1 and 100 microns of polymer 2, and thereto Teflon® cloth was embedded on the polymer 2 side by vacuum lamination. This covered laminate was then saponified. The sulfonic acid group-containing ion-exchange membrane was subjected to reduction treatment to yield carboxylic acid groups with respect to polymer 1 side surface only thereof. The membrane used in this example was manufactured as above.

Referring to operation, into anode compartments, an aqueous NaCl solution, 5.3N, 60° C., was fed at 130 lit/hr, and, into cathode compartments, an aqueous dilute NaOH solution was circulated at 130 lit/hr, in order to remove electrolytic heat. The operation was controlled so as to keep 90° C., 6.5N at the outlet above.

Figure 4:
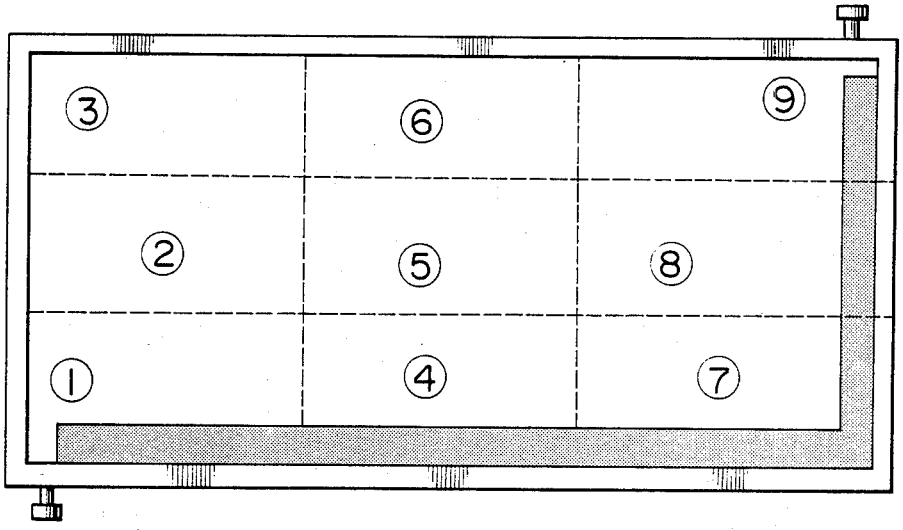
FIG. 4 shows locations of sample collection conducted in experimental works of this invention.

After the operation was brought to be in equilibrium in 2–3 hours under current density of 40 A/dm$^2$, 5N HCl was added to anolyte. In the meantime, test samples were taken up at nine spots as indicated in FIG. 4 and these samples were analyzed to determine concentrations of NaCl and NaOH. Then, the uniformity of distribution (herein referred to as "uniformity") was defined by the ratio of the highest data divided by the lowest one measured in a compartment.

Results are shown in Table 1, including, as a control experiment, a result obtained through forced circulation at 1 $m^3$/hr for both electrolytes. Current efficiency thereof was 95%, based on NaOH produced.

TABLE 1

| | | with duct | no duct | Control |
|---|---|---|---|---|
| Uniformity | anode compt. | 1.18 | 1.80 | 1.15 |
| | cathode compt. | 1.06 | 1.65 | 1.05 |
| Voltage (volt per pair) | fresh anolyte | 3.34 | 3.45 | 3.34 |
| | $H^+$ =0 | | | |
| | = 0.05 | 3.34 | 3.50 | 3.32 |
| | = 0.15 | 3.34 | 3.60 | |
| | = 0.30 | 3.34 | 3.90 | |

Note:
1. Compt. above and hereinafter is abbreviation of "compartment".

The table above proves that the duct-provided case compares favorably to operation with forced circulation and that the no-duct-provided case incurs a voltage increase due to worsening uniformity and partial undissociation of carboxylic acid groups of the ion-exchange membrane due to increase in acid concentration.

EXAMPLE 2

Except for altering the acid concentration in anolyte to be 0.20N, Example 2 was carried out under the same conditions as Example 1, chiefly to find the effects of varying the height of a duct. Results are shown in Table 2.

TABLE 2

| | | Height of Duct (cm) | | | | |
|---|---|---|---|---|---|---|
| | | 113 | 110 | 80 | 50 | 20 |
| Uniformity | anode compt. | 1.55 | 1.21 | 1.21 | 1.30 | 1.60 |
| | cathode compt. | 1.30 | 1.07 | 1.09 | 1.21 | 1.53 |
| Voltage (volt/pair) | | 3.60 | 3.36 | 3.36 | 3.38 | 3.65 |

The results above prove that adequate height of a duct is more than 50 cm and that a headroom above the upper opening is preferred to be more than 5 cm.

EXAMPLE 3

The same operating conditions as Example 2 were employed and it was intended to find effects due to variation of positioning upper and lower openings of a duct, by use of the same duct having 100 cm height. Experiments were carried out under conditions that, where the upper position is altered, the lower position is fixed at 5 cm above the inlet for electrolyte, and that, where the lower position is altered, the upper position is kept intact just below the outlet. Results are shown in Table 3.

TABLE 3

| Distance from outlet or inlet (cm) | | Uniformity | | Voltage |
|---|---|---|---|---|
| | | anode compt. | cathode compt. | (volt/pair) |
| Upper opening | 10 | 1.18 | 1.07 | 3.35 |
| | 40 | 1.20 | 1.09 | 3.35 |
| | 80 | 1.26 | 1.14 | 3.37 |
| | 120 | 1.30 | 1.21 | 3.39 |
| Lower opening | 10 | 1.20 | 1.08 | 3.35 |
| | 40 | 1.22 | 1.12 | 3.43 |
| | 80 | 1.30 | 1.24 | 3.50 |
| | 120 | 1.40 | 1.31 | 3.80 |

Results in Table 3 indicate that the upper position has minor influence over the uniformity and the voltage variation. In contrast, the lower position has definite influence over the outcomes above. In conclusion, the lower position should preferably be adjusted, in relation to the inlet, within ⅓ of transverse length of the current applied area, more preferably, within 10 cm.

EXAMPLE 4

According to the Example 2, the influence of the projected area of a duct on the current applied area was studied. In experiments, vertical ducts were lined with an interval of 10 cm, beginning at the position just below the outlet on the ceiling. Also, vertical ducts above were connected by a horizontal one while the height thereof was controlled at 105 cm and the lower opening was adjusted to 2 cm off the inlet.

TABLE 4

| Projected area of duct ($dm^2$) | Number of vertical ducts | | |
|---|---|---|---|
| | Uniformity | | Voltage (volt/pair) |
| | Anode compt. | Cathode compt. | |
| 2/34 | 1.15 | 1.06 | 3.33 |
| 4/49 | 1.10 | 1.04 | 3.29 |
| 10/94 | 1.15 | 1.05 | 3.36 |
| 15/132 | 1.28 | 1.23 | 3.45 |

Table 4 indicates the trend that the greater number of vertical ducts enhances the uniformity, but where the total projected area of vertical ducts exceeds ⅓ of the current applied area, electrolytic voltage adversely increases. This is probably because ducts block upward passage for evolved gas.

EXAMPLE 5

A cation exchange membrane designed to apply to the same electrolytic cell in Example 1 was manufactured by a polymer which had been derived from tetrafluoroethylene and perfluoro-3,6-dioxy-4-methyl-7-octenesulfonylfluoride. The polymer above having a equivalent weight of 1100 was heat fabricated to a film with 130 microns, on which Teflon® was embedded by vacuum lamination. Thereafter, the film was saponified to provide a sulfonic acid group-containing cation exchange membrane. By use of the above, KCl aqueous solution was electrolyzed.

Anolyte was a mixture of an aqueous KCl solution (70° C., 3.5N, 300 lit/hr·compartment) and HCl (4N, 6 lit/hr·compartment). Catholyte was a dilute aqueous KOH solution, which was controlled at the outlet so as to keep 7N, 90° C.

The electrolysis was conducted under 40 A/$dm^2$ and the uniformity, voltage and current efficiency calculated by amount of product KOH are shown in Table 5. The control therein is one in which forced circulation, 1 $m^3$/hr·compartment, was conducted.

The data reported in

TABLE 5

| | | with duct | no duct | control |
|---|---|---|---|---|
| Uniformity | Anode compt. | 1.16 | 1.45 | 1.15 |
| | Cathode compt. | 1.14 | 1.46 | 1.08 |
| Voltage (volt/pair) | | 3.80 | 4.20 | 3.75 |
| Current efficiency (%) | | 96 | 90 | 96 |

Table 5 proves that the duct-provided case brings about equal performance to the control and that the no-duct-provided case incurs voltage increase and current efficiency drop due to worsening uniformity.

EXAMPLE 6

In the apparatus of Example 1, ducts were removed from cathode compartments and the uniformity in the cathode compartment was studied in relation to electrolysis voltage while an amount of catholyte feed was changed and acidity of fresh anolyte was kept at $H^+=0$. Results are shown in Table 6, where data obtained in the duct-provided-case in the cathode compartment in Example 1 are added.

TABLE 6

| Duct in cathode comp. | Feed rate of catholyte (lit/hr. compt.) | Uniformity | Voltage (volt/pair) |
|---|---|---|---|
| No duct | 200 | 1.40 | 3.37 |
| | 400 | 1.21 | 3.35 |
| | 1000 | 1.05 | 3.33 |
| With duct | 130 | 1.06 | 3.34 |

In view of current passed [40 $A/dm^2 \times (115^{cm} \times 235^{cm})/100$] and the table above, forced circulation without a duct in the cathode compartment requires circulation amount of more than 30 lit/hr.KA compt. in preference, and provision of the duct gives a result equal to forced circulation.

EXAMPLE 7

In a bipolar system electrolytic cell in which 80 pairs of a unit cell of Example 1 were assembled, an aqueous NaCl solution was electrolized with observation on behavior of leakage current. Specifications of hoses used to feed and discharge the electrolytes are shown below:

| Application | This invention Inner diameter (mm) × Length (m) | Control (Forced circulation) Inner diameter (mm) × Length (m) |
|---|---|---|
| Anole inlet | 6 × 1 | 12 × 1 |
| Anole outlet | 10 × 1 | 20 × 1 |
| Cathode inlet | 6 × 1 | 12 × 1 |
| Cathode outlet | 10 × 1 | 20 × 1 |

Other electrolysis conditions are, except to set $H^+=0$, the same as Example 1. Results are shown in Table 7.

| | Voltage (V/pair) | Leakage current (%) | Current efficiency (%) for product NaOH |
|---|---|---|---|
| With duct | 3.34 | 0.3 | 95.9 |
| Forced circulation | 3.33 | 1.2 | 95.0 |

As shown in Table 7, electrolytic cells with ducts can serve with less electrolytic feeds. Accordingly, smaller diameter hoses are allowed for use in feeding and discharging electrolytes so that a decrease of current leakage and better current efficiency are attained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A chlor-alkali electrolytic cell which is divided by a cation exchange membrane to define an anode compartment and a cathode compartment, each compartment having at the lower part thereof an inlet for fresh electrolyte and in the upper part thereof an outlet for spent electrolyte and electrolytic products, each compartment further including an electrode with a front side thereof being disposed close to said cation exchange membrane and having a rear space behind said electrode, and at least one of said compartments including a duct positioned within said rear space, said inlet and said outlet being positioned diagonally opposite to each other in the compartment, said duct comprising a horizontal portion having a lower opening near the inlet for fresh electrolyte and at least one vertical portion communicating with and substantially perpendicular to said horizontal portion, and having an upper opening near the outlet for spent electrolyte and electrolytic product, the ratio of the area of the duct projected against the electrode to the area of the electrolytic field being less than $\frac{1}{3}$:1, whereby an electrolyte flow is established through said duct from the upper part to the lower part of the compartment.

2. An electrolytic cell according to claim 1, wherein said lower opening of said duct is positioned, in terms of horizontal distance relative to the inlet for fresh electrolyte within $\frac{1}{3}$ of the transverse length of the current applied area.

3. An electrolytic cell according to claim 2, wherein said lower opening of said duct is positioned within 10 cm from the inlet for fresh electrolyte.

4. An electrolytic cell according to claim 2, wherein said upper opening of said duct is positioned, in terms of horizontal distance relative to the outlet for spent electrolyte and electrolytic product, within $\frac{1}{3}$ of the transverse length of the current applied area.

5. An electrolytic cell according to claim 2, wherein the duct is more than 50 cm in height.

6. An electrolytic cell according to claim 5, wherein said cation exchange membrane is a cation exchange membrane incorporating carboxylic acid groups.

7. An electrolytic cell according to claim 5, wherein said cell is a bipolar system electrolytic cell.

8. An electrolytic cell according to claim 2, wherein said cation exchange membrane is a cation exchange membrane incorporating carboxylic acid groups.

9. An electrolytic cell according to claim 2, wherein said cell is a bipolar system electrolytic cell.

10. An electrolytic cell according to claim 2, wherein said electrodes are planar and made of expanded metal, lined metal rods, net-like metal, or perforated metal sheet.

11. An electrolytic cell according to claim 2, wherein said cell is assembled like a filter press assembly.

12. An electrolytic cell according to claim 1, wherein said upper opening of said duct is positioned, in terms of horizontal distance relative to the outlet for spent electrolytic and electrolytic product, within $\frac{1}{3}$ of the transverse length of the current applied area.

13. An electrolytic cell according to claim 1, wherein the duct has an L-shape.

14. An electrolytic cell according to claim 1, wherein the duct is more than 50 cm in height.

15. An electrolytic cell according to claim 1, wherein said cation exchange membrane is a cation exchange membrane incorporating carboxylic acid groups.

16. An electrolytic cell according to claim 1, wherein said cell is a bipolar system electrolytic cell.

17. An electrolytic cell according to claim 1, wherein said electrodes are planar and made of expanded metal, lined metal rods, net-like metal, or perforated metal sheet.

18. An electrolytic cell according to claim 14, wherein said cell is assembled like a filter press assembly.

19. A chlor-alkali electrolytic cell which is divided by a cation exchange membrane to define an anode compartment and a cathode compartment, each compartment having at the lower part thereof an inlet for fresh electrolyte and in the upper part thereof an outlet for spent electrolyte and electrolytic products, each compartment further including and electrode with a front side thereof being disposed close to said cation exchange membrane and having a rear space behind said electrode and each of said compartments includes a duct positioned within said rear space, said duct having an L-shape and comprising:

(a) a horizontal portion having said lower opening near the inlet for fresh electrolyte and at least one vertical portion, communicating with said horizontal portion, having said upper opening in the upper part of the compartment;

(b) said lower opening in said duct being positioned, in terms of horizontal distance relative to the inlet for fresh electrolyte, within $\frac{1}{3}$ of the transverse length of the current applied area; and (c) said upper opening of said duct being positioned, in terms of horizontal distance relative to the outlet for spent electrolyte and electrolytic product, within $\frac{1}{3}$ of the transverse length of the current applied area, whereby an electrolyte flow is established through said duct from the upper part to the lower part of the compartment.

20. A chlor-alkali electrolytic cell which is divided by a cation exchange membrane to define an anode compartment and a cathode compartment, each compartment having at the lower part thereof an inlet for fresh electrolyte and in the upper part thereof an outlet for spent electrolyte and electrolytic products, each compartment further including an electrode with a front side thereof being disposed close to said cation exchange membrane and having a rear space behind said electrode and at least one of said compartments including a duct positioned within said rear space, said duct comprising;

(a) a horizontal portion having a lower opening near the inlet for fresh electrolyte and at least one vertical portion communicating with and substantially perpendicular to said horizontal portion, and having an upper opening near the outlet for spent electrolyte and electrolytic product;

(b) said lower opening in said duct being positioned, in terms of horizontal distance relative to the inlet for fresh electrolyte, within $\frac{1}{3}$ of the transverse length of the current applied area;

(c) said upper opening of said duct being positioned, in terms of horizontal distance relative to the outlet for spent electrolyte and electrolytic product, within $\frac{1}{3}$ of the transverse length of the current applied area;

(d) the height of said duct being at least 50 cm; and (e) the ratio of the area of the duct projected against the electrode to the area of the electrolytic field being less than $\frac{1}{3}$:1, whereby an electrolyte flow is established through said duct from the upper part to the lower part of the compartment.

21. An electrolytic cell according to claim 20, wherein said lower opening of said duct is positioned within 10 cm from said inlet for fresh electrolyte and said upper opening of said duct is positioned, in terms of vertical distance, greater than 5 cm from said outlet for spent electrolyte and electrolytic product.

22. An electrolytic cell according to claim 20, wherein said upper opening of said duct is positioned, in terms of vertical distance, within 10–15 cm from said outlet for spent electrolyte and electrolytic product.

23. An electrolytic cell according to claim 20, wherein said cation exchange membrane is a cation exchange membrane incorporating carboxylic acid groups.

24. An electrolytic cell according to claim 20, wherein said cell is a bipolar system electrolytic cell.

25. An electrolytic cell according to claim 20, wherein said electrodes are planar and made of expanded metal, lined metal rods, net-like metal, or perforated metal sheet.

26. An electrolytic cell according to claim 20, wherein said cell is assembled like a filter press assembly.

27. An electrolytic cell according to claim 20, wherein the duct has an L-shape.

28. A chlor-alkali electrolytic cell which is divided by a cation exchange membrane to define an anode compartment and a cathode compartment, each compartment having at the lower part thereof an inlet for fresh electrolyte and in the upper part thereof an outlet for spent electrolyte and electrolytic products, each compartment further including an electrode with a front side thereof being disposed close to said cation exchange membrane and having a rear space behind said electrode and at least one of said compartments including a duct positioned within said rear space, said duct comprising;

(a) a horizontal portion having a lower opening near the inlet for fresh electrolyte and at least one vertical portion communicating with and substantially perpendicular to said horizontal portion, and having an upper opening near the outlet for spent electrolyte and electrolytic product;

(b) said lower opening in said duct being positioned, in terms of horizontal distance relative to the inlet for fresh electrolyte, within $\frac{1}{3}$ of the transverse length of the current applied area, and within 10 cm from said inlet for fresh electrolyte;

(c) said upper opening of said duct being positioned, in terms of horizontal distance relative to the outlet for spent electrolyte and electrolytic product, within $\frac{1}{3}$ of the transverse length of the current applied area;

(d) the height of said duct being at least 50 cm; and (e) the ratio of the area of the duct projected against the electrode to the area of the electrolytic field being less than $\frac{1}{3}$:1, whereby an electrolyte flow is established through said duct from the upper part to the lower part of the compartment.

29. A chlor-alkali electrolytic cell which is divided by a cation exchange membrane to define an anode compartment and a cathode compartment, each compartment having at the lower part thereof an inlet for fresh electrolyte and in the upper part thereof an outlet for spent electrolyte and electrolytic produces, each compartment further including an electrode with a front side thereof being disposed close to said cation exchange membrane and having a rear space behind said electrode and at least one of said compartments including a duct positioned within said rear space, said duct comprising;

(a) a horizontal portion having a lower opening near the inlet for fresh electrolyte and at least one vertical portion communicating with and substantially perpendicular to said horizontal portion, and having an upper opening near the outlet for spent electrolyte and electrolytic product;

(b) said lower opening in said duct being positioned, in terms of horizontal distance relative to the inlet for fresh electrolyte, within $\frac{1}{3}$ of the transverse length of the current applied area, and within 10 cm from said inlet for fresh electrolyte;

(c) said upper opening of said duct being positioned, in terms of horizontal distance relative to the outlet for spent electrolyte and electrolytic product, within $\frac{1}{3}$ of the transverse length of the current applied area, and in terms of vertical distance, greater than 5 cm from said outlet for spent electrolyte and electrolytic product;

(d) the height of said duct being at least 50 cm; and (d) the ratio of the area of the duct projected against the electrode to the area of the electrolytic field being less than $\frac{1}{3}$:1, whereby an electrolyte flow is established through said duct from the upper part to the lower part of the compartment.

* * * * *